US011027547B2

(12) United States Patent
Hashimoto et al.

(10) Patent No.: US 11,027,547 B2
(45) Date of Patent: Jun. 8, 2021

(54) LIQUID EJECTION HEAD

(71) Applicant: CANON KABUSHIKI KAISHA, Tokyo (JP)

(72) Inventors: Yusuke Hashimoto, Yokohama (JP); Kenji Fujii, Yokohama (JP); Hiroyuki Murayama, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/779,081

(22) Filed: Jan. 31, 2020

(65) Prior Publication Data

US 2020/0247119 A1 Aug. 6, 2020

(30) Foreign Application Priority Data

Feb. 4, 2019 (JP) ..... JP2019-018017
Jan. 15, 2020 (JP) ..... JP2020-004247

(51) Int. Cl.
*B41J 2/14* (2006.01)

(52) U.S. Cl.
CPC ..... *B41J 2/1404* (2013.01); *B41J 2/14* (2013.01); *B41J 2002/14403* (2013.01); *B41J 2002/14475* (2013.01)

(58) Field of Classification Search
CPC .. B41J 2/1404; B41J 2/14; B41J 2002/14475; B41J 2002/14403
See application file for complete search history.

(56) References Cited

U.S. PATENT DOCUMENTS 7,287,847 B2 10/2007 Fujii et al.
8,608,303 B2 * 12/2013 Murayama ..... B41J 2/1629 347/93
2016/0347065 A1 * 12/2016 Watanabe ..... B41J 2/1628

FOREIGN PATENT DOCUMENTS

JP 2005-178364 A 7/2005

* cited by examiner

*Primary Examiner* — Geoffrey S Mruk
(74) *Attorney, Agent, or Firm* — Venable LLP

(57) ABSTRACT

A liquid ejection head includes a substrate, an ejection orifice forming member having a plurality of ejection orifices for ejecting a liquid, and an intermediate layer provided between the substrate and the ejection orifice forming member. The substrate has a supply path for supplying the liquid to the plurality of ejection orifices, the ejection orifice forming member has a common liquid chamber communicating with the plurality of ejection orifices, the supply path and the common liquid chamber communicate with each other via a filter portion including a plurality of holes formed in the intermediate layer, the ejection orifice forming member has a wall portion that protrudes into the common liquid chamber at a position opposed to the filter portion, and the wall portion extends along a direction intersecting an arrangement direction of the plurality of ejection orifices.

15 Claims, 8 Drawing Sheets

LIQUID EJECTION HEAD

BACKGROUND OF THE INVENTION

Field of the Invention

The present disclosure relates to a liquid ejection head.

Description of the Related Art

There is known a liquid ejection head that ejects a liquid such as an ink from an ejection orifice to record an image on a recording medium. One of features for reliability required for the liquid ejection head is to suppress an entry of dust and foreign matter into the ejection orifice. The problem is that the liquid supplied to the liquid ejection head contains the dust or the foreign matter. In order to suppress such entry of the dust or the foreign matter in the liquid and improve the reliability of the liquid ejection head, a technique of providing a filter in the liquid ejection head is known. Japanese Patent Application Laid-Open No. 2005-178364 describes a liquid ejection head in which a membrane filter structure is formed in an opening portion of a liquid supply path that penetrates a substrate.

SUMMARY OF THE INVENTION

A liquid ejection head of the present disclosure includes a substrate, an ejection orifice forming member having a plurality of ejection orifices for ejecting a liquid, and an intermediate layer provided between the substrate and the ejection orifice forming member, in which the substrate has a supply path for supplying the liquid to the plurality of ejection orifices, the ejection orifice forming member has a common liquid chamber communicating with the plurality of ejection orifices, the supply path and the common liquid chamber communicate with each other via a filter portion including a plurality of holes formed in the intermediate layer, the ejection orifice forming member has a wall portion that protrudes into the common liquid chamber at a position opposed to the filter portion, and the wall portion extends along a direction intersecting an arrangement direction of the plurality of ejection orifices.

Further features of the present disclosure will become apparent from the following description of exemplary embodiments with reference to the attached drawings.

DESCRIPTION OF THE EMBODIMENTS

Figure 1A:
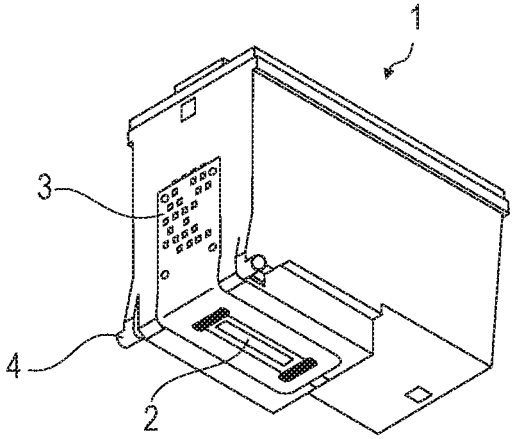
FIGS. 1A and 1B are perspective views of a liquid ejection head according to an embodiment.

When a strong impact or vibration occurs in a liquid ejection head, an air bubble may be introduced into a liquid through an ejection orifice and entrained in the liquid. When the air bubble is entrained in this manner, the air bubble stays in a common liquid chamber communicating with a plurality of ejection orifices and causes an ejection failure. Therefore, it is necessary to suck the air bubble through the ejection orifices. However, in a liquid ejection head described in Japanese Patent Application Laid-Open No. 2005-178364, since a filter is formed at an opening portion of a liquid supply path, the entrained air bubbles may be combined and enlarged in the common liquid chamber on the filter, and so-called "bubble staying" may occur during suction. When the bubble staying occurs, liquid ejection failure occurs, causing a reduction in image quality. Although occurrence of the bubble staying is able to be suppressed by increasing the liquid suction amount, in that case, the amount of waste liquid due to suction increases. Therefore, an aspect of the present disclosure is to provide a liquid ejection head that achieves high reliability while suppressing wasteful liquid consumption due to suction.

Hereinafter, embodiments of the present disclosure will be described with reference to the drawings. In the following description, components having the same function may be given the same reference numerals in the drawings, and the description thereof may be omitted.

Figure 1B:
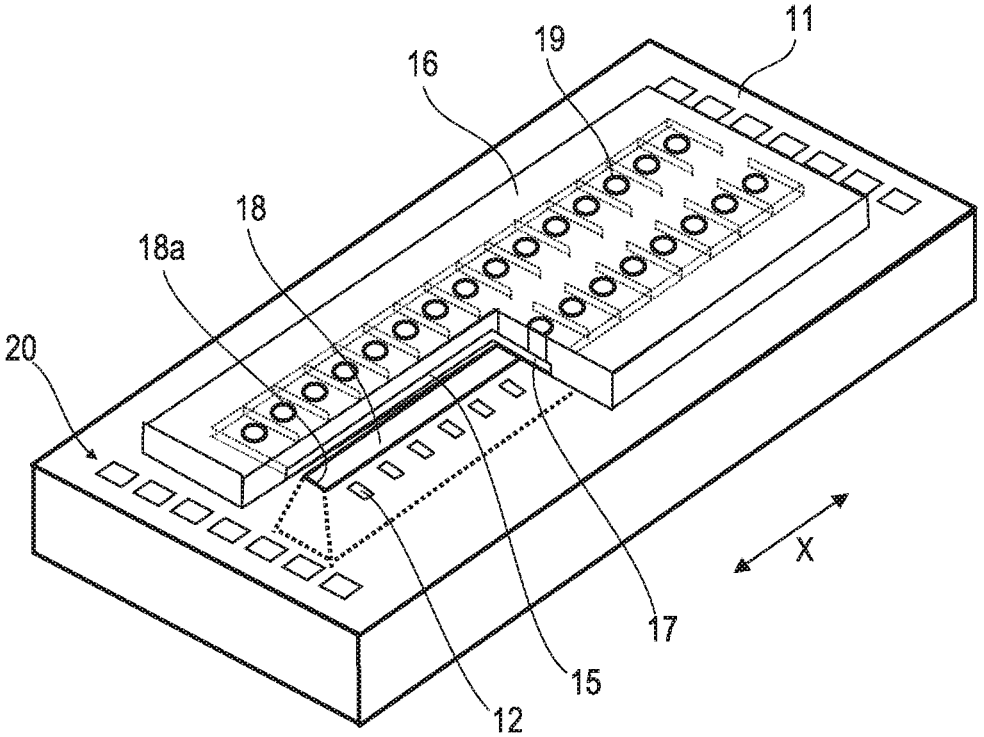

FIG. 1A is a perspective view of a liquid ejection head according to an embodiment of the present disclosure. FIG. 1B is a perspective view of a recording element substrate forming the liquid ejection head of the present embodiment. A liquid ejection head 1 is a head that ejects a liquid such as an ink to record an image on a recording medium, and includes a recording element substrate 2, an electrical wiring substrate 3, and a support member 4. The recording element substrate 2 and the electrical wiring substrate 3 are bonded to the support member 4 so that the recording element substrate 2 is located in the opening portion (not illustrated in FIGS. 1A and 1B) formed in the electrical wiring substrate 3. In a case where the support member 4 is provided with a flow path (not illustrated) for supplying the liquid to the recording element substrate 2, and two or more types of liquids are supplied, it is preferable that a dividing wall is formed in the flow path so that these liquids are not mixed.

The recording element substrate 2 includes a substrate 11 and an ejection orifice forming member 16 provided on the substrate 11. The ejection orifice forming member 16 is formed with a plurality of ejection orifices 19 for ejecting a liquid, a plurality of flow paths 17 each communicating with the ejection orifices 19, and a common liquid chamber 15 communicating with the plurality of flow paths 17. The plurality of ejection orifices 19 are arranged at a predetermined pitch along a longitudinal direction of the ejection orifice forming member 16 to form two parallel ejection orifice rows. The common liquid chamber 15 is disposed between these two ejection orifice rows. An arrangement direction of the plurality of ejection orifices 19 is along the longitudinal direction of the opening of the common liquid chamber 15. In FIGS. 1A and 1B, the arrangement direction of the plurality of ejection orifices 19 is parallel to the longitudinal direction of the opening of the common liquid chamber 15. The substrate 11 is provided with an energy generating element 12, which is a heating element generating energy used for ejecting the liquid, at a position opposed to the ejection orifice 19. With this thermal energy, the liquid in the flow path 17 is able to be foamed and ejected from the ejection orifice 19. As the energy generating element 12, a piezoelectric element (piezo element) that generates a pressure by deforming a wall of the flow path 17 and ejects the liquid is able to be used in addition to a heating element (heater). In addition, a supply path 18 that penetrates the substrate 11 and communicates with the flow path of the support member 4 is formed in the substrate 11. The supply path 18 is a path for supplying the liquid to the plurality of ejection orifices 19, and includes an opening portion 18*a* that opens along an arrangement direction (hereinafter, referred to as "arrangement direction of ejection orifices") X of the ejection orifice 19 on a surface of the substrate 11 opposed to the ejection orifice forming member 16. Although a plurality of energy generating elements 12 form two element rows corresponding to the two ejection orifice rows including the plurality of ejection orifices 19, the opening portion 18*a* of the supply path 18 is located between these two element rows. A connection terminal group 20 for supplying a drive signal and drive power to the energy generating element 12 is also formed at an end portion of the substrate 11 in the longitudinal direction.

Figure 2A:
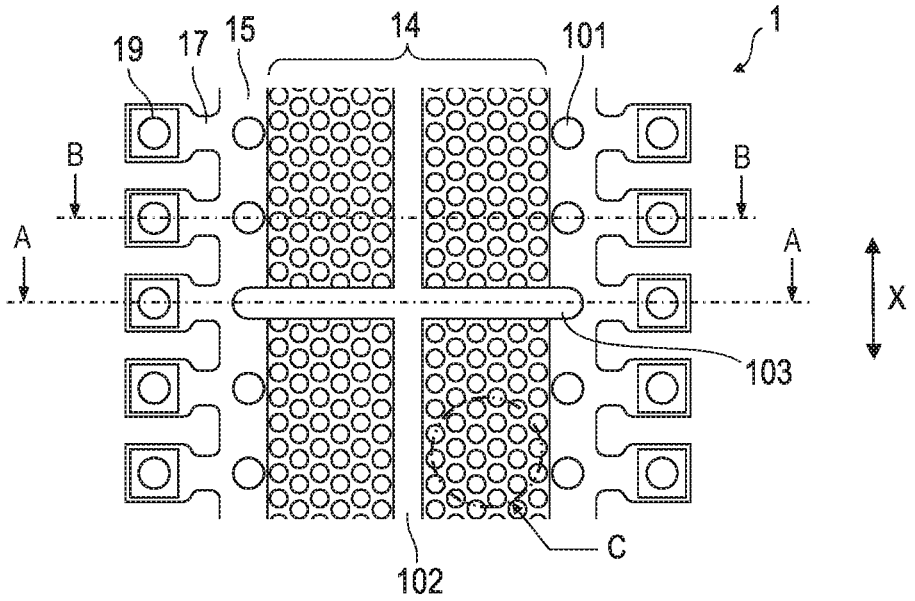
FIGS. 2A, 2B and 2C are a perspective plan view and cross-sectional views of the liquid ejection head according to the embodiment.
Figure 2B:
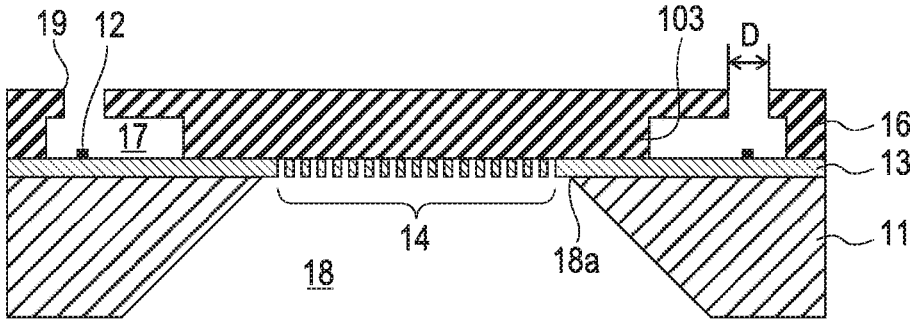
Figure 2C:
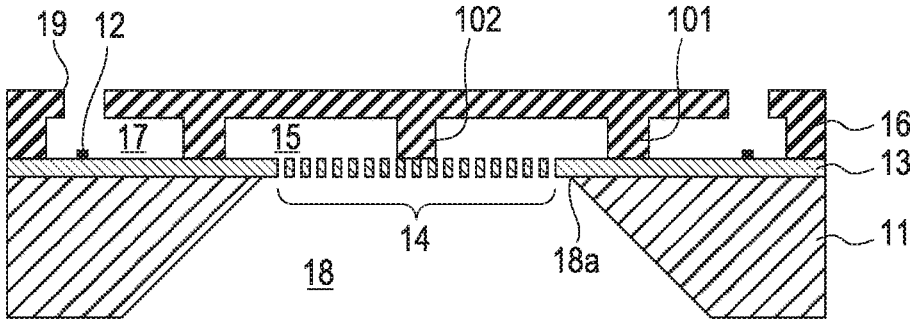
Figure 3:
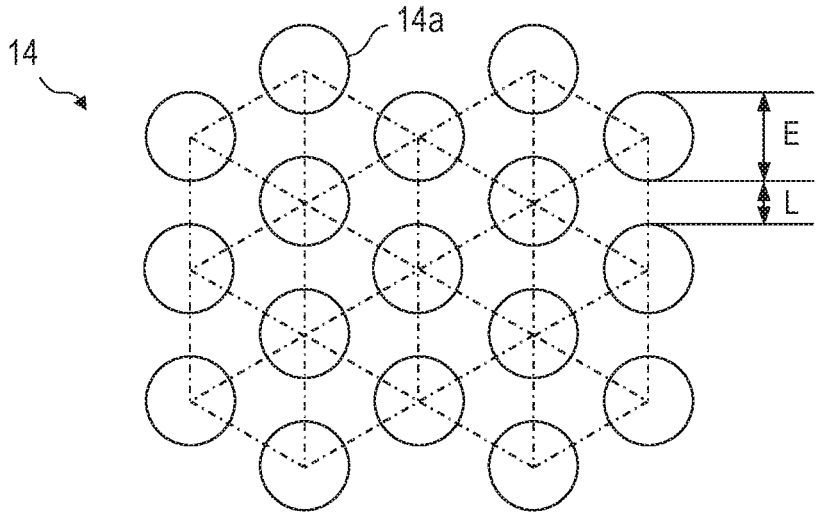
FIG. 3 is an enlarged view of a region surrounded by a circle C in FIG. 2A.

FIG. 2A is an enlarged perspective plan view illustrating a vicinity of the ejection orifice of the liquid ejection head of the present embodiment. FIG. 2B is a cross-sectional view taken along line A-A in FIG. 2A, and FIG. 2C is a cross-sectional view taken along line B-B in FIG. 2A. FIG. 3 is an enlarged view of a region surrounded by a circle C in FIG. 2A. The liquid ejection head 1 includes an adhesion layer 13 as an intermediate layer between the substrate 11 and the ejection orifice forming member 16. The adhesion layer 13 has a function of improving adhesion between the substrate 11 and the ejection orifice forming member 16. Therefore, for example, in a case where the substrate 11 is formed of silicon and the ejection orifice forming member 16 is formed of an epoxy resin, the adhesion layer 13 preferably is formed of a polyether amide resin. The adhesion layer 13 includes a filter portion 14 in a region opposed to the supply path 18 and the common liquid chamber 15. In other words, the supply path 18 and the common liquid chamber 15 communicate with each other through the filter portion 14 of the adhesion layer 13. The filter portion 14 includes a plurality of holes 14*a* and has a function of removing dust and foreign matter contained in the liquid supplied from the supply path 18 to the common liquid chamber 15 and suppressing the dust and the foreign matter from entering the ejection orifice 19. From this viewpoint, each hole 14*a* preferably satisfies a relationship of D>E, where D is a diameter of the ejection orifice 19 and E is a diameter of the hole 14*a*.

Furthermore, in order to improve the performance of the filter portion 14, it is preferable that the diameter of the hole 14*a* is made as small as possible and an interval between the adjacent holes 14*a* is made as narrow as possible. However, when the plurality of holes 14*a* are configured in this manner, a pressure loss (flow resistance) increases and the flow of the liquid degrades, and a liquid ejection speed is affected. Therefore, it is not preferable to unnecessarily reduce the diameter or the interval of the holes 14*a*. That is, since a trade-off relationship is established between the performance of the filter portion 14 including the plurality of holes 14*a* and the pressure loss (flow resistance), the diameter or the interval of the holes 14*a* is preferably determined in consideration of a balance between a filter performance and a liquid supply performance. From such a viewpoint, it is preferable that the relationship of L>E/2 is satisfied, where E is the diameter of the hole 14*a* and L is the interval between the two adjacent holes 14*a*. In addition, the plurality of holes 14*a* are preferably disposed in a triangular lattice shape so that the centers of the three adjacent holes 14*a* are located at apexes of an equilateral triangle. As a result, the filter performance and the liquid supply performance are able to be made compatible.

In addition, the liquid ejection head 1 includes a columnar protrusion 101 and a beam-shaped protrusion 102 as two types of protrusions that are formed on the ejection orifice forming member 16 and protrude into the common liquid chamber 15. The columnar protrusion 101 is provided at a position facing an inlet of the flow path 17. The columnar protrusion 101 functions as a filter that removes the dust or the foreign matter in the liquid supplied to the ejection orifice 19 through the flow path 17. In addition, the beam-shaped protrusion 102 is provided along an arrangement direction of the ejection orifices X at a position opposed to the filter portion 14 of the adhesion layer 13. The beam-shaped protrusion 102 is disposed on a center line of the common liquid chamber 15 along the arrangement direction of the ejection orifices X. It is preferable that the beam-shaped protrusion 102 abuts on the filter portion 14 at a tip end in a protruding direction, thereby the filter portion 14 formed between the supply path 18 and the common liquid chamber 15 is able to be held and the strength thereof is able to be improved.

Figure 4A:
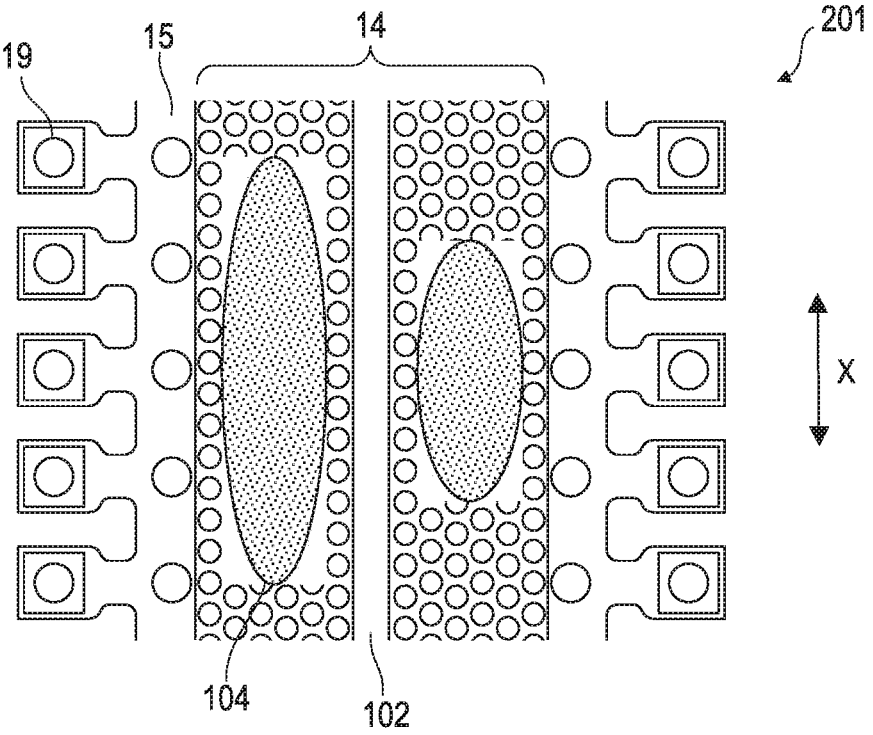
FIGS. 4A and 4B are perspective plan views illustrating a state where air bubbles staying in a common liquid chamber are combined.
Figure 4B:
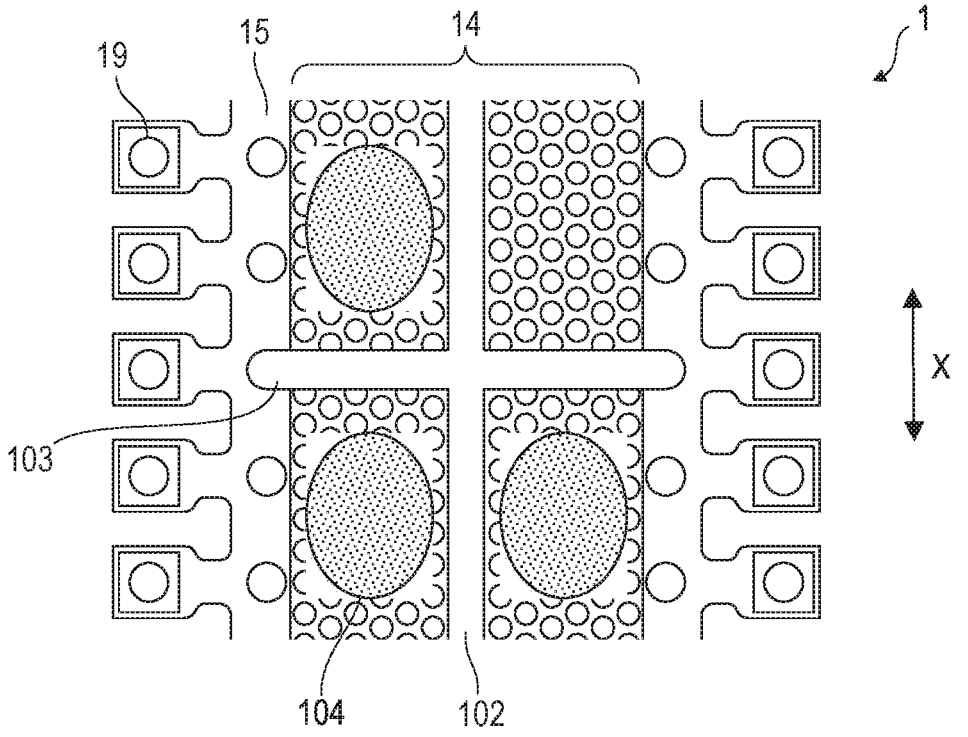

Furthermore, the ejection orifice forming member 16 is formed with a dividing wall (wall portion) 103 protruding into the common liquid chamber 15. The dividing wall 103 is provided on both sides of the beam-shaped protrusion 102 and extends along a direction intersecting the arrangement direction of the ejection orifices X (longitudinal direction of the opening of the common liquid chamber 15). The fact that the dividing wall 103 extends along the direction intersecting the arrangement direction of the ejection orifices X means that the dividing wall 103 extends within an inclination range of 20 degrees or less with respect to a direction perpendicular to the arrangement direction of the ejection orifices X. Preferably, the dividing wall 103 extends along a direction perpendicular to the arrangement direction of the ejection orifices X (parallel to the perpendicular direction). The dividing wall 103 preferably abuts on the filter portion 14, similarly to the beam-shaped protrusion 102; thereby the filter portion 14 formed between the supply path 18 and the common liquid chamber 15 is able to be held and the strength thereof is able to be improved. In addition, the dividing wall 103 is disposed at a position corresponding to the flow path 17 in the arrangement direction of the ejection orifices X, and includes an end portion facing the flow path 17. Therefore, similarly to the columnar protrusion 101, the dividing wall 103 also functions as a filter for removing the dust or the foreign matter in the liquid. In addition, in a case where the air bubble is embraced in the liquid through the ejection orifice 19, the dividing wall 103 also has a function of suppressing such an air bubble from being combined and enlarged in the arrangement direction of the ejection orifices X, in addition to the functions described above. Hereinafter, this function will be described with reference to FIGS. 4A and 4B. FIG. 4A is a perspective plan view illustrating a state where air bubbles staying in the common liquid chamber are combined in the liquid ejection head not provided with the dividing wall. FIG. 4B is a perspective plan view illustrating a state where air bubbles staying in the common liquid chamber are combined in the liquid ejection head of the present embodiment provided with the dividing wall.

As illustrated in FIG. 4A, in the liquid ejection head 201 not provided with the dividing wall 103, there is no structure that divides the common liquid chamber 15 in the arrangement direction of the ejection orifices X. Therefore, in a case where air bubbles 104 entrained in the liquid through the ejection orifice 19 stay on the filter portion 14 in the common liquid chamber 15, the air bubbles are combined in the arrangement direction of the ejection orifices X and enlarged, and a liquid ejection failure may occur. In order to suppress the liquid ejection failure, it is conceivable to suck the air bubble 104 through the ejection orifice 19, and due to the enlarged air bubble 104, there is a possibility that the bubble staying may occur during suction. Although occurrence of the bubble staying is able to be suppressed by increasing the liquid suction amount, in that case, the amount of waste liquid due to suction increases. On the other hand, as illustrated in FIG. 4B, in the liquid ejection head 1 of the present embodiment, the dividing wall 103 that divides the common liquid chamber 15 in the arrangement direction of the ejection orifices X is provided. As a result, even in a case where the air bubbles 104 entrained in the liquid through the ejection orifice 19 stay on the filter portion 14 in the common liquid chamber 15, it is possible to suppress the air bubbles from being combined and enlarged in the arrangement direction of the ejection orifices X. As a result, the filter portion 14 is provided between the supply path 18 and the common liquid chamber 15. Therefore, it is possible to suppress an enlargement of air bubbles in the common liquid chamber 15 and to suppress wasteful liquid consumption due to suction, while securing high reliability.

Figure 5A:
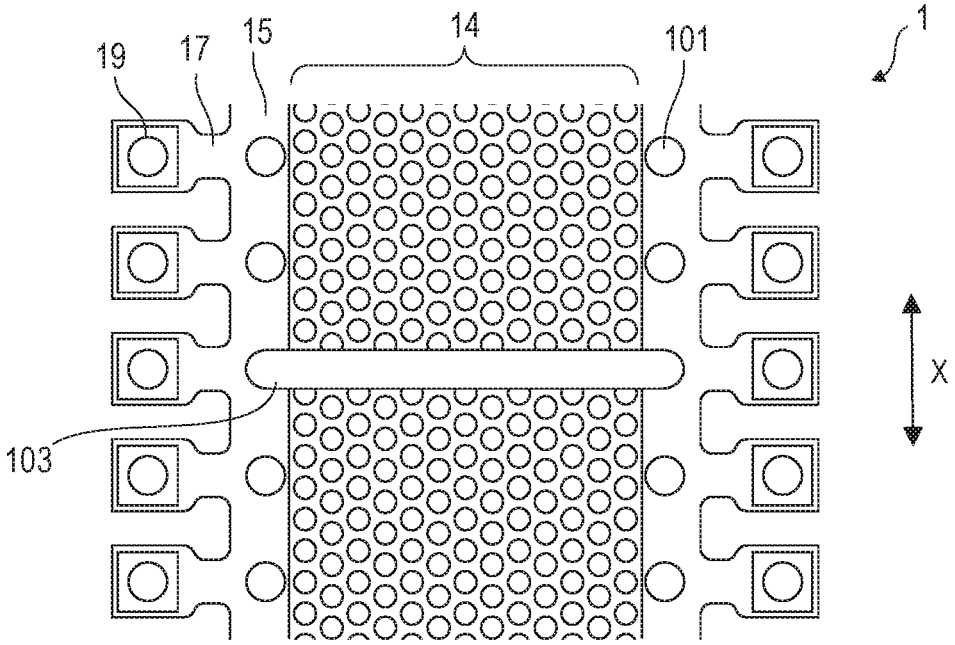
FIGS. 5A and 5B are perspective plan views illustrating a modification example of the liquid ejection head according to the embodiment.
Figure 5B:
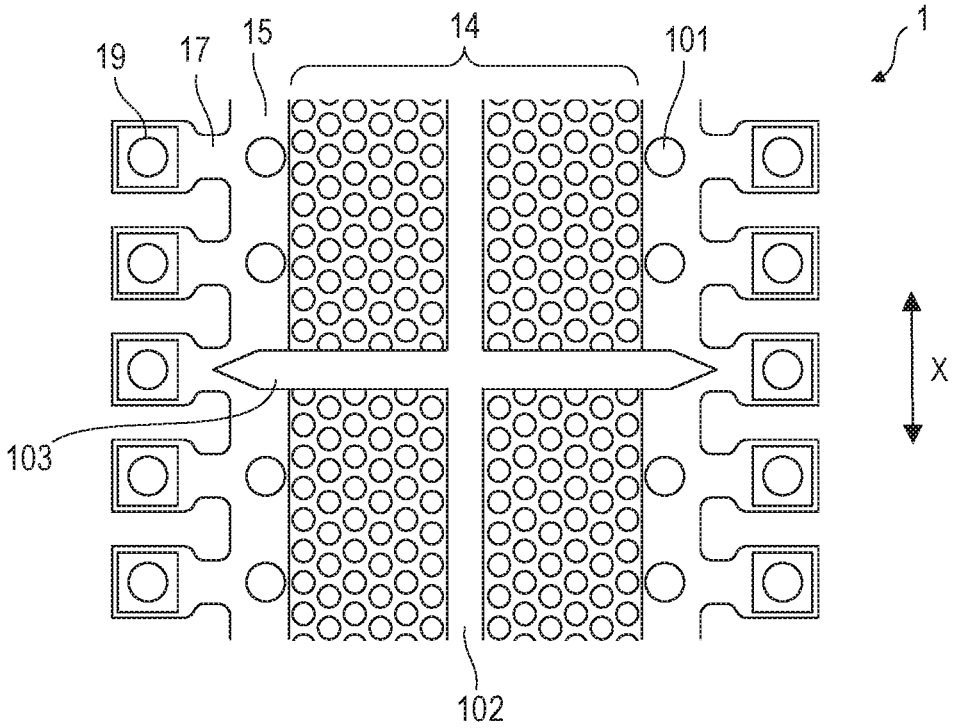

As described above, the dividing wall 103 preferably abuts on the filter portion 14 from the viewpoint of improving the strength of the filter portion 14. However, the dividing wall 103 may not abut on the filter portion 14, and there may be a gap of approximately several μm between the dividing wall 103 and the filter portion 14, from the viewpoint of suppressing the enlargement of air bubbles in the common liquid chamber 15. In addition, a planar shape and disposition of the dividing wall 103 are not limited to the shape and disposition described above. FIGS. 5A, 5B, 6A, and 6B are perspective plan views illustrating modification examples of such a dividing wall. It is preferable that both the dividing wall (wall portion) 103 and the filter portion 14 are formed of organic resins. As illustrated in FIG. 5A, the liquid ejection head 1 may not be provided with the beam-shaped protrusions 102, that is, only the dividing wall 103 may be provided. In addition, as illustrated in FIG. 5B, an end portion of the dividing wall 103 may have a shape (tapered shape) a width of which decreases toward the flow path 17 when viewed from a liquid ejection direction. In order to suitably suppress combining of air bubbles, it is preferable that a plurality of dividing walls 103 extending along the direction intersecting an arrangement direction of the ejection orifices are provided in the arrangement direction of the ejection orifices. That is, it is preferable that the plurality of dividing walls 103 are provided so as not to overlap in the arrangement direction of the ejection orifices. Specifically, it is preferable that three or more dividing walls 103 are provided in the arrangement direction of the ejection orifices. When there are a dividing wall A and a dividing wall B connected via the beam-shaped protrusion 102, the plurality of dividing walls are provided (that is, the dividing wall A and the dividing wall B are regarded as separate dividing walls).

Figure 6A:
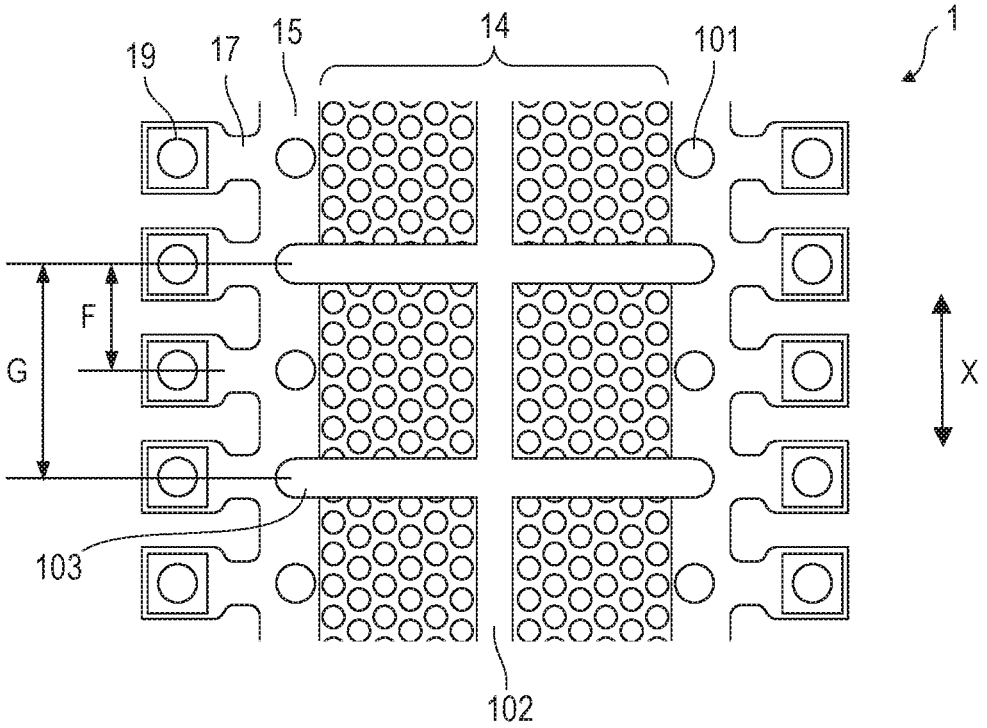
FIGS. 6A and 6B are perspective plan views illustrating a modification example of the liquid ejection head according to the embodiment.
Figure 6B:
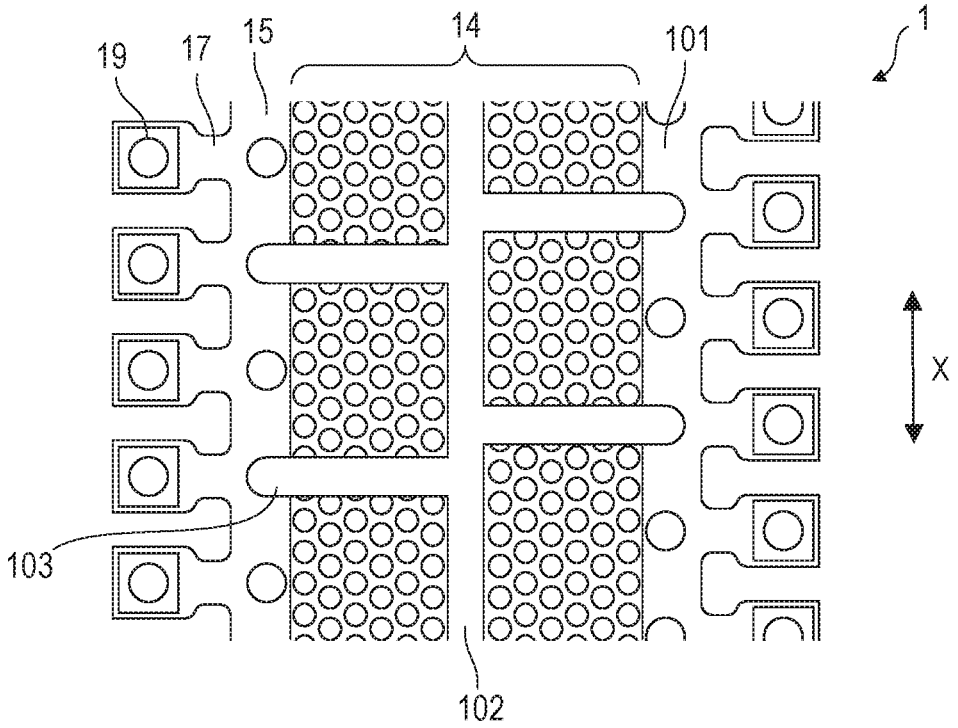

In addition, as illustrated in FIG. 6A, the plurality of dividing walls 103 may be provided on both sides of the beam-shaped protrusion 102, respectively. In this case, in order to cause the plurality of dividing walls 103 to abut on the filter portion 14 to improve the strength of the filter portion 14, it is preferable to narrow the interval between the adjacent dividing walls 103 in the arrangement direction of the ejection orifices X as much as possible. However, when the interval between the dividing walls 103 is too narrow, the pressure loss (flow resistance) increases, the liquid flow degrades, and the liquid ejection speed is affected. That is, a trade-off relationship is established between the strength improvement of the filter portion 14 by the plurality of dividing walls 103 and the pressure loss (flow resistance). Therefore, it is preferable that the interval between the dividing walls 103 is determined in consideration of the balance between the strength improvement of the filter portion 14 and the liquid supply performance. From such a viewpoint, in the arrangement direction of the ejection orifices X, it is preferable that the relationship of $G \geq 2F$ is satisfied when the interval between the plurality of ejection orifices 19 is F and the interval between the plurality of dividing walls 103 is G. As a result, the strength improvement of the filter portion 14 and liquid supply performance are able to be made compatible. The disposition of the plurality of dividing walls 103 may not be symmetrical with respect to the beam-shaped protrusion 102 as illustrated in FIG. 6A, and may be asymmetric with respect to the beam-shaped protrusion 102 as illustrated in FIG. 6B, when viewed from the liquid ejection direction. In this case, the strength of the filter portion 14 is able to be further improved by allowing the plurality of dividing walls 103 to abut on the filter portion 14 as compared with the case where the plurality of dividing walls 103 is disposed symmetrically.

Next, with reference to FIGS. 7A, 7B, 7C, 8A, 8B, and 8C, a method of manufacturing the liquid ejection head according to the present embodiment will be described. FIGS. 7A, 7B, 7C, 8A, 8B, and 8C are schematic cross-sectional views of the liquid ejection head in each step of the manufacturing method according to the present embodiment, and are views corresponding to FIG. 1B.

Figure 7A:
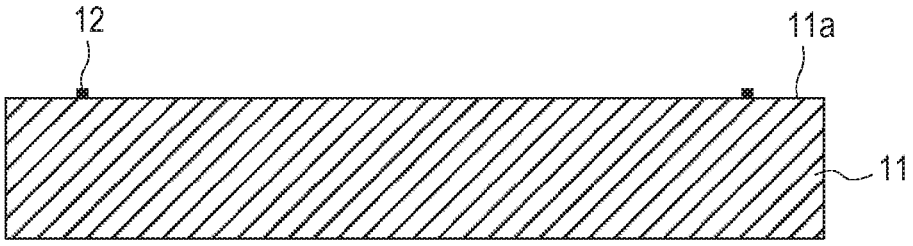
FIGS. 7A, 7B and 7C are cross-sectional views illustrating a method of manufacturing the liquid ejection head according to the embodiment.
Figure 7B:
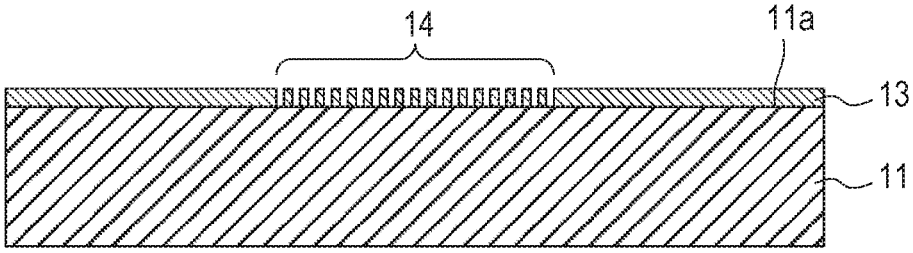

First, a substrate 11 formed of single crystal silicon and whose main surface is a (100) surface is prepared. As illustrated in FIG. 7A, an energy generating element 12 is provided on a surface 11*a* of the substrate 11. Next, an organic resin such as a polyether amide resin is applied to the surface 11*a* of the substrate 11 and patterned to form an adhesion layer 13 having a filter portion 14 as illustrated in FIG. 7B. As a method of applying a resin, a spin coating method, a direct coating method, a spray method, or the like is able to be used. In addition, the patterning is performed by applying a resist, performing exposure and development to form a resist pattern, and by etching using the resist pattern as an etching mask. Patterning may be performed directly using a photosensitive resin material, or a desired pattern may be formed by attaching a film.

Figure 7C:
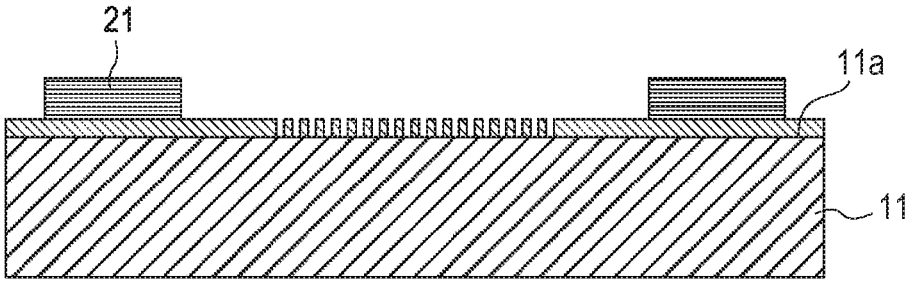
Figure 8A:
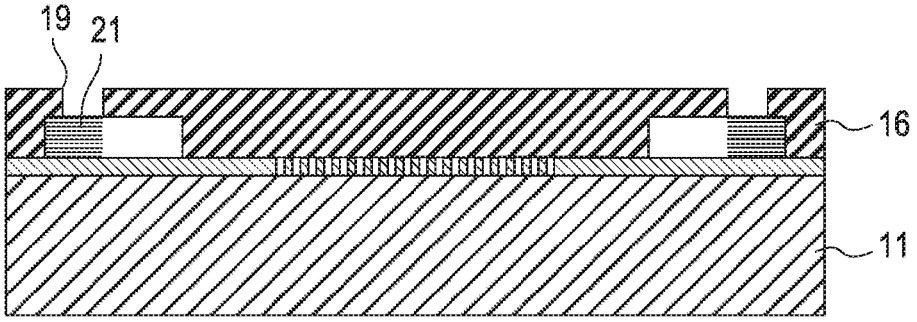
FIGS. 8A, 8B and 8C are cross-sectional views illustrating a method of manufacturing the liquid ejection head according to the embodiment.

Next, as illustrated in FIG. 7C, a mold material 21 for forming the common liquid chamber 15 and the flow path 17 is formed in the surface 11*a* of the substrate 11 by patterning. Patterning of the mold material 21 is performed by applying a resist, performing exposure and development to form a resist pattern, and etching using the resist pattern as a mask. Patterning may be performed directly using a photosensitive resin material, or a desired pattern may be formed by attaching a film. Next, an organic resin such as an epoxy resin is applied on the mold material 21 and patterned, thereby forming the ejection orifice forming member 16 having the ejection orifices 19 as illustrated in FIG. 8A. As a method of applying a resin, a spin coating method, a direct coating method, a spray method, or the like is able to be used. In addition, patterning is performed by removing a portion corresponding to the ejection orifice 19 by exposure and development. A resist pattern may be formed and patterned by etching using the resist pattern as an etching mask, or a desired pattern may be formed by attaching a film.

Figure 8B:
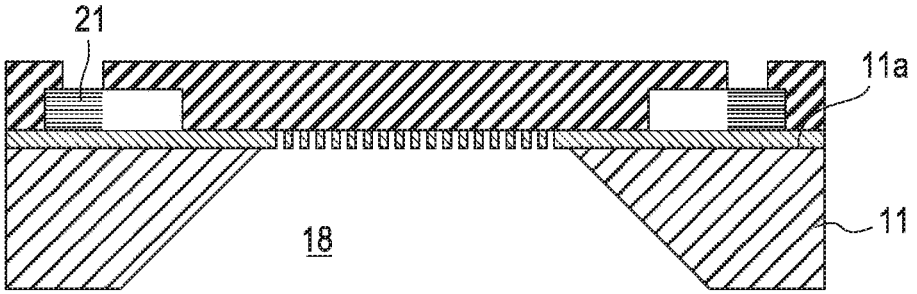
Figure 8C:
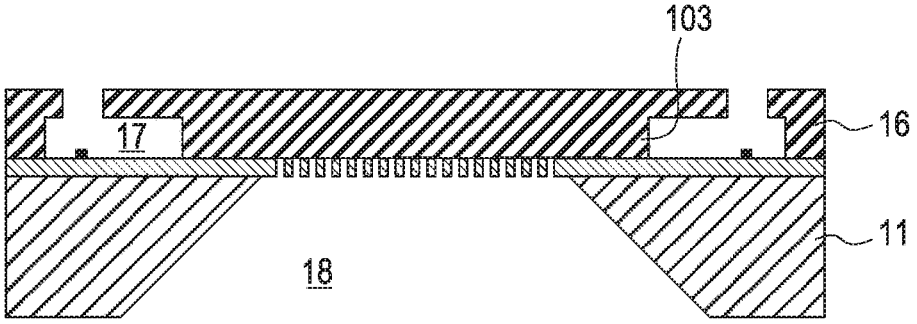

Next, after protecting the surface 11*a* of the substrate 11 with cyclized rubber, tape, or the like, the substrate 11 is etched to form a supply path 18 in the substrate 11 as illustrated in FIG. 8B. An etching time is able to be shortened by forming a leading hole in advance. Therefore, it is preferable to form an etching mask having an opening by patterning a resin layer in advance on a rear surface 11*b* of the substrate 11, and to form a leading hole in the substrate 11 through the opening thereof. As a method of forming the leading hole, laser beam irradiation, a drill, or the like is able to be used. Etching of the substrate 11 may be wet etching using a liquid exhibiting a desired alkalinity, or dry etching using a gas having a desired ratio. Thereafter, the cyclized rubber or tape that protects the substrate 11 is removed, and the mold material 21 for forming the common liquid chamber 15 and the flow path 17 is removed. As a result, as illustrated in FIG. 8C, the common liquid chamber 15 and the flow path 17 are formed in the ejection orifice forming member 16, and the dividing wall 103 protruding into the common liquid chamber 15 is formed. A recording element substrate 2 is obtained by cutting and separating the substrate 11 with a laser sorter or a dicing sorter.

Next, a support member 4 for bonding the recording element substrate 2 is prepared. The support member 4 may be formed by molding a resin material or an alumina material, or may be formed by sintering a powder material. In a case of molding a resin material, a filler formed of glass or the like may be mixed into the resin material in order to improve the shape rigidity. As the material of the support member 4, a resin material such as modified polyphenylene ether (PPE), a ceramic material typified by $Al_2O_3$, or the like is able to be used widely. Next, the corresponding lead terminal group of the electrical wiring substrate 3 is bonded to a connection terminal group 20 of the recording element substrate 2. An adhesive is applied to a recessed portion of the support member 4, and the recording element substrate 2 is bonded to the support member 4 so that the flow path of the support member 4 and the supply path 18 of the recording element substrate 2 communicate with each other. A method of applying the adhesive may be transferred using a transfer pin, or drawing application using a dispenser. As an adhesive used here, in a case where an ink is used as a liquid, an ink having good ink resistance is preferable. For example, a thermosetting adhesive containing an epoxy resin as a main component is able to be used. In this manner, the recording element substrate 2 bonded to the electrical wiring substrate 3 is bonded to the support member 4, whereby the liquid ejection head 1 illustrated in FIGS. 1A and 1B is formed.

While the present disclosure has been described with reference to exemplary embodiments, it is to be understood that the disclosure is not limited to the disclosed exemplary embodiments. The scope of the following claims is to be accorded the broadest interpretation so as to encompass all such modification examples and equivalent structures and functions.

This application claims the benefit of Japanese Patent Application No. 2019-018017, filed Feb. 4, 2019, and Japanese Patent Application No. 2020-004247, filed Jan. 15, 2020, which are hereby incorporated by reference herein in their entirety.

What is claimed is:

1. A liquid ejection head comprising:

a substrate;

an ejection orifice forming member having a plurality of ejection orifices for ejecting a liquid; and an intermediate layer provided between the substrate and the ejection orifice forming member, wherein the substrate has a supply path for supplying the liquid to the plurality of ejection orifices, the ejection orifice forming member has a common liquid chamber communicating with the plurality of ejection orifices, the supply path and the common liquid chamber communicate with each other via a filter portion including a plurality of holes formed in the intermediate layer, the ejection orifice forming member has a wall portion that protrudes into the common liquid chamber at a position opposed to the filter portion, the wall portion extends along a direction intersecting an arrangement direction of the plurality of ejection orifices, and the wall portion is formed at the position overlapping with the plurality of holes when viewed from a direction perpendicular to the face of the supply path side of the filter portion.

2. The liquid ejection head according to claim 1, wherein the wall portion abuts on the filter portion.

3. The liquid ejection head according to claim 1, wherein the wall portion has an end portion facing a flow path that allows the common liquid chamber to communicate with the ejection orifice.

4. The liquid ejection head according to claim 3, wherein the end portion of the wall portion has a shape a width of which decreases toward the flow path when viewed from a liquid ejection direction.

5. The liquid ejection head according to claim 1, wherein the ejection orifice forming member has a plurality of the wall portions.

6. The liquid ejection head according to claim 5, wherein the common liquid chamber is located between two parallel ejection orifice rows having the plurality of ejection orifices, and the plurality of wall portions are disposed on both sides of a center line of the common liquid chamber along the arrangement direction.

7. The liquid ejection head according to claim 6, wherein the plurality of wall portions are disposed asymmetrically with respect to the center line when viewed from a liquid ejection direction.

8. The liquid ejection head according to claim 5, wherein a relationship of $G \geq 2F$ is satisfied, where F is an interval between the plurality of ejection orifices and G is an interval between the plurality of wall portions in the arrangement direction.

9. The liquid ejection head according to claim 1, wherein a relationship of $D > E$ is satisfied, where D is a diameter of the ejection orifices and E is a diameter of the holes of the filter portion.

10. The liquid ejection head according to claim 9, wherein the plurality of holes of the filter portion satisfy a relationship of L>E/2, where L is an interval between two adjacent holes.

11. The liquid ejection head according to claim 10, wherein the plurality of holes are disposed in a triangular lattice shape so that centers of three adjacent holes are located at apexes of an equilateral triangle.

12. The liquid ejection head according to claim 1, wherein each of the filter portion and the wall portion is formed of an organic resin.

13. The liquid ejection head according to claim 1, wherein the substrate is formed of silicon, the filter portion is formed of a polyether amide resin, and the wall portion is formed of an epoxy resin.

14. The liquid ejection head according to claim 1, wherein a plurality of the wall portions are provided in a direction intersecting the arrangement direction of the plurality of ejection orifices.

15. The liquid ejection head according to claim 1, wherein the arrangement direction of the plurality of ejection orifices is along a longitudinal direction of an opening of the common liquid chamber.

* * * * *